US008683642B2

(12) United States Patent
Weng

(10) Patent No.: US 8,683,642 B2
(45) Date of Patent: Apr. 1, 2014

(54) DUAL-FUNCTIONAL SCREEN CLEANER

(75) Inventor: Jin-Sheng Weng, Taipei (TW)

(73) Assignee: Taiwan Bor Ying Corporation, New Taipei (TW)

( * ) Notice: Subject to any disclaimer, the term of this patent is extended or adjusted under 35 U.S.C. 154(b) by 379 days.

(21) Appl. No.: 13/171,477

(22) Filed: Jun. 29, 2011

(65) Prior Publication Data

US 2012/0006911 A1 Jan. 12, 2012

(30) Foreign Application Priority Data

Jul. 8, 2010 (TW) ..... 99213072 U

(51) Int. Cl.
*A47L 23/04* (2006.01)
*A46B 11/00* (2006.01)

(52) U.S. Cl.
USPC ..... 15/118; 15/244.4; 401/118; 401/139

(58) Field of Classification Search
USPC ..... 15/118, 244.1, 244.4; 401/137, 139, 401/118; 222/173
See application file for complete search history.

(56) References Cited

U.S. PATENT DOCUMENTS 7,841,795 B2 * 11/2010 Huang ..... 401/137

* cited by examiner

*Primary Examiner* — David Redding
(74) *Attorney, Agent, or Firm* — CKC & Partners Co., Ltd.

(57) ABSTRACT

A dual-functional screen cleaner has a housing unit, a cleaning body, and a cleaning liquid container. The housing unit has a first housing and a second housing opposite the first housing. The first housing and the second housing have a first housing trough and a second housing trough respectively. The second housing trough has an upper housing trough and a lower housing trough opposite the upper housing trough. The cleaning body is removably accommodated in the lower housing trough. The cleaning liquid container is located in the upper housing trough.

11 Claims, 8 Drawing Sheets

DUAL-FUNCTIONAL SCREEN CLEANER

RELATED APPLICATIONS

This application claims priority to Taiwan Application Serial Number 099213072, filed Jul. 8, 2010, which is herein incorporated by reference.

BACKGROUND

1. Field of Invention

The present invention relates to a cleaner. More particularly, the present invention relates to a dual-functional screen cleaner.

2. Description of Related Art

Touch reader, such as tablet PC, cell phone, iPad, iPhone, e-BOOK and etc., are portable and usually provided with a touch screen enabling users to operate. Since touch reader is portable and easily transported, user can carry touch reader to any places and use it anytime.

During operation, dust and dirt are usually attached on the touch screen when using touch reader outside or in an unclean environment. In addition, fingerprints usually leave on the touch screen after using fingers to operate touch reader. These dust and fingerprints significantly affect the clarity of the touch screen. Therefore, dust and fingerprints should be removed for visual clarity However, articles, such as tissue and handkerchief, with rough surface, are improper to clean the touch screen, which may scratch the touch screen. The touch screen should be cleaned with a specific cleaning fabric in stead. Besides, a cleaning liquid may be provided and spray on the screen before wiping it in order to remove fingerprints and dirt.

The current commercial available screen cleaner sets provide a bottle with the cleaning liquid and a cleaning fabric separately, thus those screen cleaner sets are bulk and are not easily transported. Therefore, it is inconvenient to clean the touch reader when using touch reader outside.

SUMMARY

The conventional screen cleaner sets are bulk and not easily transported. The present disclosure has been made in order to solve the above-mentioned problems. Accordingly, it is an object of the present disclosure to provide a dual-functional screen cleaner, which is portable and easily transported.

The present invention is directed to a dual-functional screen cleaner. The dual-functional screen cleaner comprises a housing unit, a cleaning body and a cleaning liquid container. The housing unit comprises a first housing and a second housing opposite the first housing, the first housing and the second housing have a first housing trough and a second housing trough respectively. The second housing trough comprises an upper housing trough and a lower housing trough opposite the upper housing trough. The first housing has a first end and a second end opposite the first end, and the second housing has a third end and a fourth end opposite the third end. The first fastening member detachably fastens the second end to the third end. The cleaning body is removably accommodated in the lower housing trough, wherein a part of the cleaning body protrudes out of the third end. The cleaning liquid container locates in the upper housing trough, wherein the cleaning liquid container has a accommodating room and a protrusion that communicate with each other. The protrusion protrudes out of the top of the upper housing trough and faces the fourth end. The tube screws to the protrusion. The pressuring element caps the tube. Accordingly, the dual-functional screen cleaner is portable and easily transported as a result of providing the housing unit with the cleaning liquid container and the cleaning body integrally.

The present disclosure also provides another dual-functional screen cleaner. The dual-functional screen cleaner comprises a housing unit, a cleaning body and a cleaning liquid container. The housing unit comprises a first housing and a second housing opposite the first housing, and the first housing and the second housing have a first housing trough and a second housing trough respectively. The first housing has a first end and a corresponding second end. The second housing has a third end and a corresponding fourth end opposite the third end. A first fastening member detachably fastens the third end to the second end. The cleaning body is removably accommodated in the first housing trough, wherein a part of the cleaning body protrudes out of the second end. The cleaning liquid container locates in the second housing trough, and the cleaning liquid container has a accommodating room and a protrusion that communicate with each other. The protrusion protrudes out of the top of the second housing trough and faces the fourth end. The tube screws to the protrusion. The pressuring element caps the tube. Accordingly, the dual-functional screen cleaner is portable and easily transported as a result of providing the housing unit with the cleaning liquid container and the cleaning body integrally.

According to one embodiment of the present disclosure, a top of the second housing trough has a hole, the cleaning liquid container is a bottle, and the bottle has a body part communicating and a protrusion. An interior of the body part defines an accommodating room. The body part is removably accommodated in the second housing trough. The protrusion passes through the hole and protrudes out of the top of the second housing trough when the body part is accommodated in the second housing trough. The cleaning liquid container could be individually accommodated in the second housing.

According to one embodiment of the present disclosure, the protrusion and the top of the upper housing trough are integrally formed, the protrusion communicates with the upper housing trough, a sealing bottom seals between the upper housing trough and the lower housing trough, the protrusion, the upper housing trough, and the sealing bottom cooperate to define the cleaning liquid container, and the upper housing trough defines the accommodating room. The second housing and the cleaning liquid container are integrally formed.

According to one embodiment of the present disclosure, the first fastening member comprises at least one first hook disposed on an outer wall of the third end and at least one first groove disposed on an inner wall of the second end, and the first hook is located opposite and detachably engages with the first groove. The first housing could be detachably engaged to the second housing.

According to one embodiment of the present disclosure, a dual-functional screen cleaner further comprises a cover and a second fastening member, where the second fastening member fastens the cover to the fourth end of the second housing.

According to one embodiment of the present disclosure, the second fastening member comprises at least one second hook disposed on an outer wall of the fourth end and at least one second groove disposed on an inner wall of the cover, where the first hook is located opposite and detachably engages with first groove.

According to one embodiment of the present disclosure, a top of the cover has a hollowed trough, the pressuring element is located in an interior of the hollowed trough, the pressuring element has a vertical channel and a horizontal nozzle that communicate with each other, the vertical channel caps the tube, and the horizontal nozzle is exposed to the hollowed trough. The pressuring element enables to control spraying cleaning liquid.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
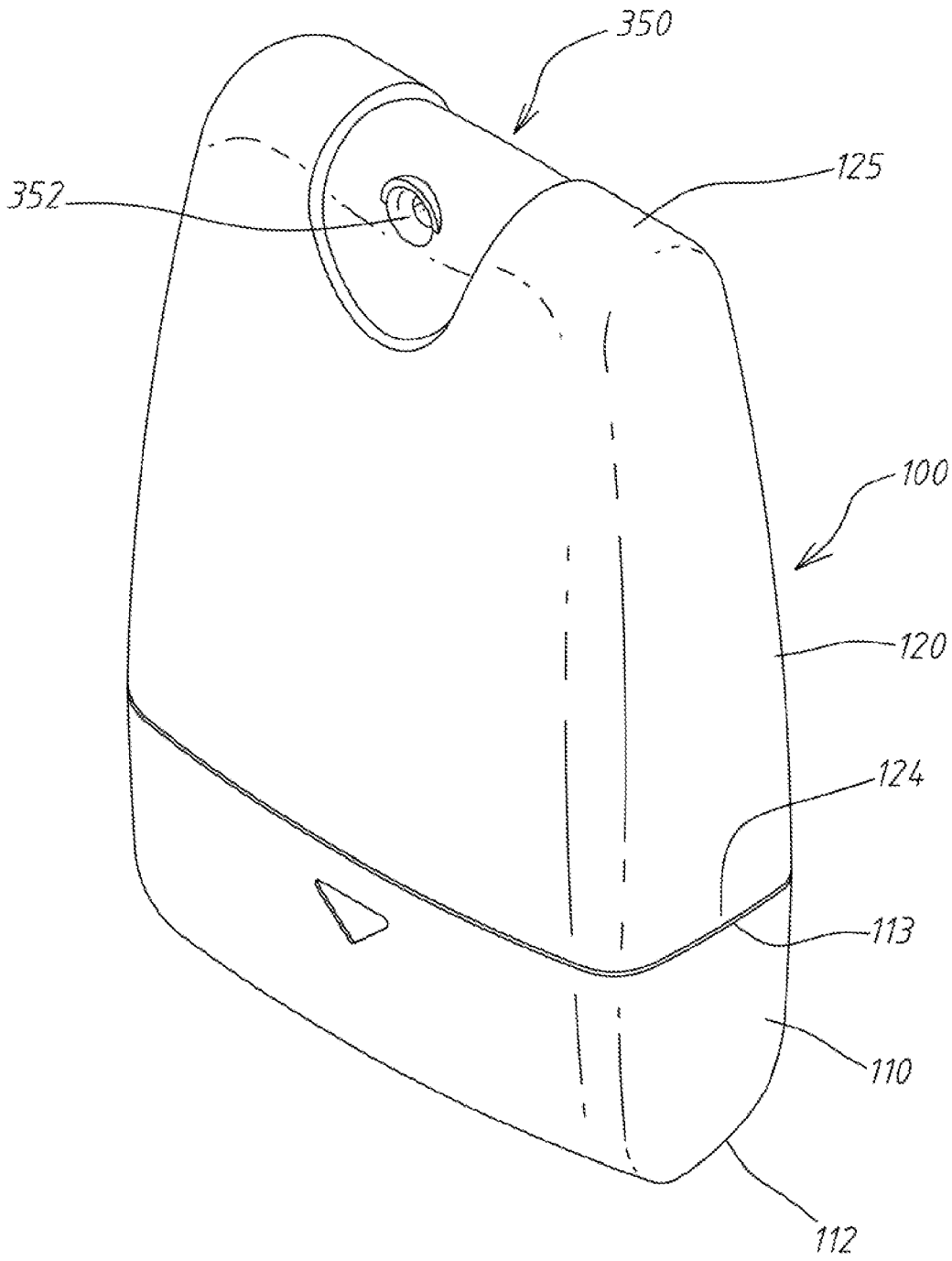
FIG. 1 illustrates a pictorial drawing of a dual-functional screen cleaner according to first embodiment of the present disclosure.
Figure 2:
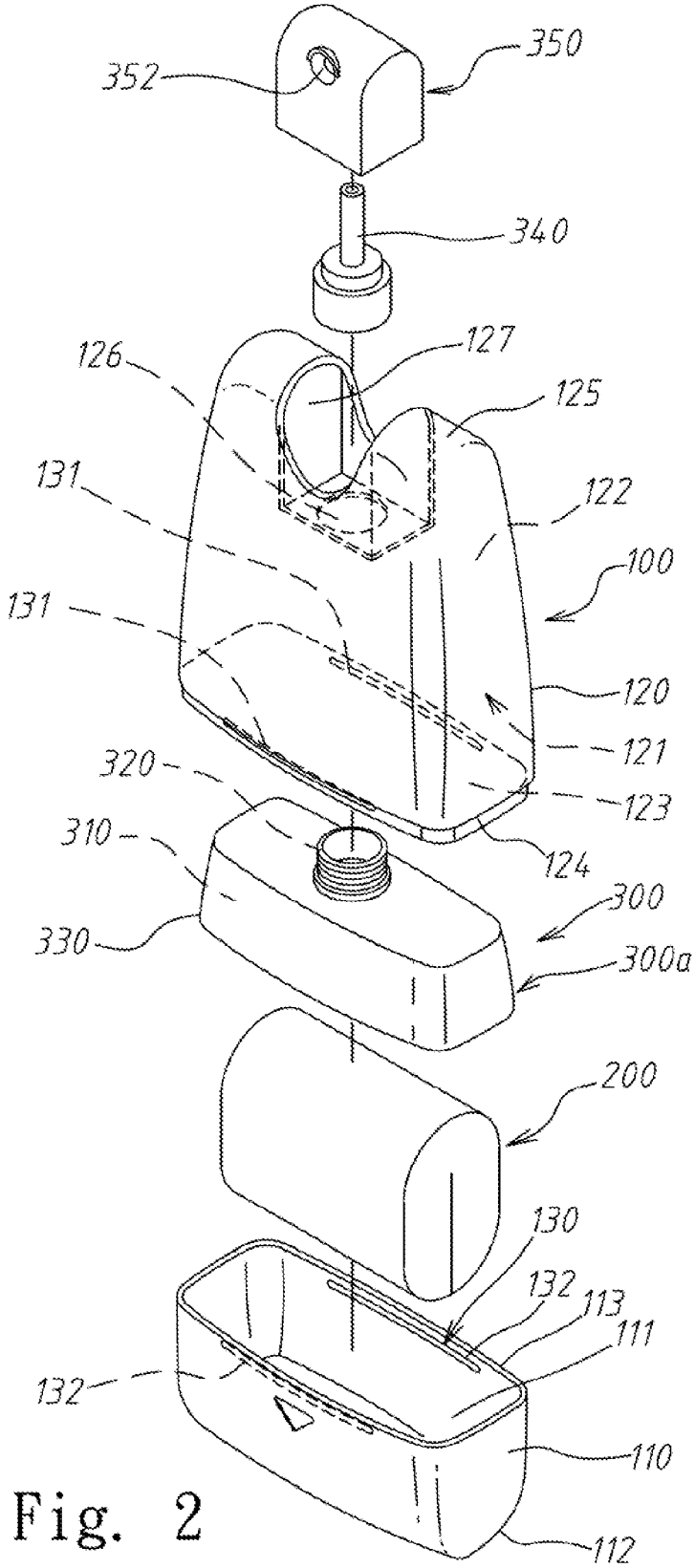
FIG. 2 illustrates an explosion diagram of the dual-functional screen cleaner of FIG. 1.

Reference will now be made in detail to the present embodiments of the invention, examples of which are illustrated in the accompanying drawings. Wherever possible, the same reference numbers are used in the drawings and the description to refer to the same or like parts.

FIG. 1 to FIG. 6 illustrate a pictorial drawing, a explosion diagram, a pictorial drawing, an explosion diagram, a pictorial drawing of the detached first and second housing, a front view, a sectional view and an enlarge view taken from C according to first embodiment of the present disclosure dual-functional screen cleaner. Referring to FIG. 1 to FIG. 6, a dual-functional screen cleaner includes a housing unit 100, a cleaning body 200 and a cleaning liquid container 300 according to first embodiment of the present disclosure.

The housing unit 100 includes a first housing 110 and a second housing 120 opposite the first housing. The first housing 110 and the second housing 120 have a first housing trough 111 and a second housing trough 121 respectively. The second housing trough 121 includes an upper housing trough 122 and a lower housing trough 123 opposite the upper housing trough 122. Further, the first housing 110 has a first end and a second end 113 opposite the first end, and the second housing having a third end 124 and a fourth end 125 opposite the third end 124. A first fastening member 130 detachably fastens the third end 124 of the second housing 120 to the second end 113 of the first housing 110.

In one embodiment, the first fastening member 130 includes at least one first hook 131 located on an outer wall of the third end 124 and at least one first groove 132 located on an inner wall of the second end 113. The first hook 131 locates opposite and detachably engages with the first groove 132, and thus the first housing 110 and the second housing 120 could be assembled. The first groove 132 can be detached from the first hook 131 of the second housing 120 while pulling down the second end 113 of the first housing 110.

The cleaning body 200 may be a fabric, which removably accommodates in the lower housing trough 123 of the second housing 120. A part of the cleaning body 200 protrudes out of the third end 124 of the second housing 120 and faces the first housing trough 111 of the first housing 110. As the first housing 110 combines with the second housing 120, the cleaning body 200 is accommodated in the lower housing trough 123 and the first housing trough 111 collectively, and a part of the cleaning body 200 protruding out of the third end 124 is covered by the first housing 110. As the first housing 110 and the second housing 120 are separated, the second housing 120 works as a holding part, and the part of the cleaning body 200 protruding out of the third end 124 enables to clean the screen. Therefore, it is very convenient to use. The cleaning body 200 could be detachably removed from the lower housing trough 123 and be replaced with a new cleaning body 200.

The cleaning liquid container 300 is located in the upper housing trough 122 of the second housing 120. The cleaning liquid container 300 has an accommodating room and a protrusion 320 that communicate with each other, where the accommodating room 310 contains a leaning liquid, and the protrusion 320 protrudes out of the top of the upper housing trough 122 and faces the fourth end 125. The protrusion 320 is screwed to a tube 340. The tube 340 caps a pressuring element 350 for pressing the cleaning liquid out from the accommodating room 310. Basically, the cleaning liquid container 300 could be an individual element, which could be further accommodated in the second housing 120, or could be formed integrally with the second housing 120.

The first embodiment of FIG. 1 to FIG. 6, the cleaning liquid container 300 is an individual element, which could be further accommodated in the second housing 120. In first embodiment, the top of the upper housing trough 122 has a hole 126. The cleaning liquid container 300 is a bottle **300*a*, the bottle 300*a* has a body part 330 communicating with the protrusion 320, an interior of the body part 330 defines the accommodating room. The body part 330 is removably accommodated in the upper housing trough 122. The protrusion 320 passes through the hole 126 and protrudes out of the top of the upper housing trough 122 when the body part 330 is accommodated in the upper housing trough. The bottle 300*a* could be detachably removed from the second housing 120 in order to replace a new bottle 300*a*** or supply the cleaning liquid when the cleaning liquid is exhausted.

Figure 8:
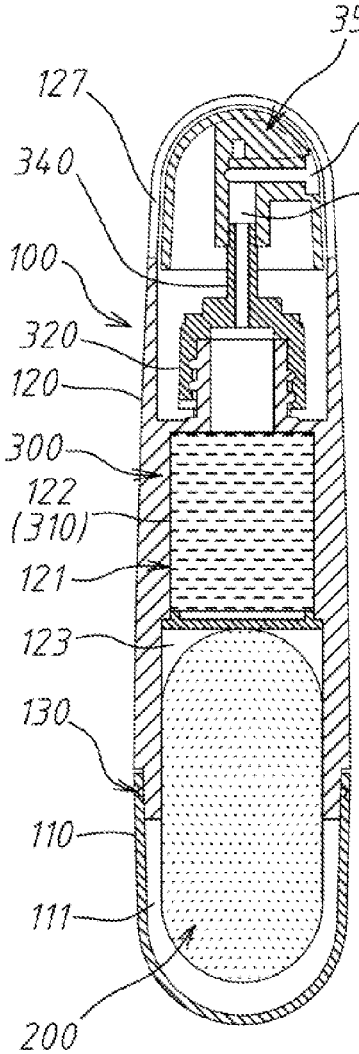
FIG. 8 illustrates a sectional view taken alone line B-B of FIG. 7.
Figure 7:
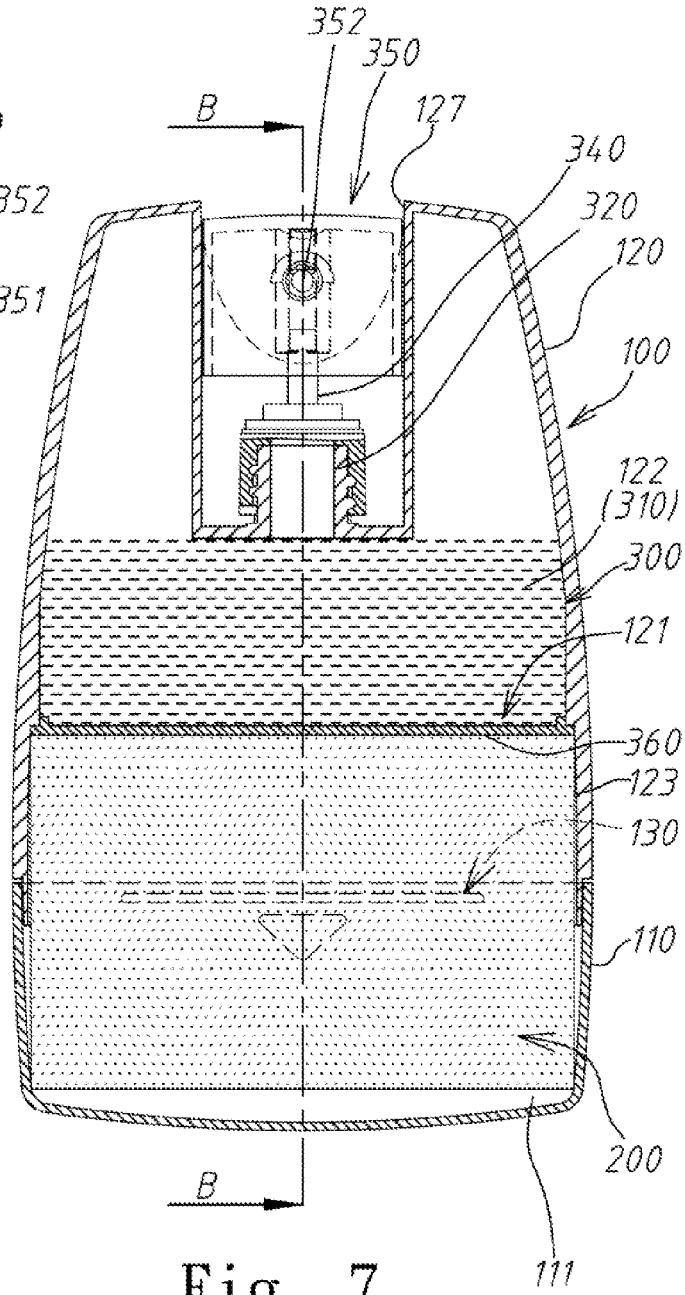
FIG. 7 illustrates a sectional view of a dual-functional screen cleaner according to second embodiment of the present disclosure.

The cleaning liquid container 300 is integrally formed with the second housing 120 in FIG. 7 and FIG. 8 of the second embodiment. In second embodiment, the protrusion 320 and the top of the upper housing trough are integrally formed, and the protrusion 320 communicates with the upper housing trough. The upper housing trough 122 and the lower housing trough 123 are sealed, by such as ultrasonic welding, with a sealing bottom 360. Accordingly, the protrusion 320, the upper housing trough 122, and the sealing bottom 360 cooperate to define the cleaning liquid container 300, and the upper housing trough 122 defines the accommodating room 310 for containing the cleaning liquid.

The fourth end 125 of the second housing has a hollowed trough 127. The pressuring element 350 has a vertical channel 351 and a horizontal nozzle 352 that communicate with each other, the vertical channel 351 is coupled with the tube 340, and the horizontal nozzle 352 is exposed to the hollowed trough 127. While pressing the pressuring element 530, the cleaning liquid could pass through the protrusion 320, the tube 340, the vertical channel 351 and the horizontal nozzle 352 and then be sprayed out from the cleaning liquid container 300.

Figure 3:
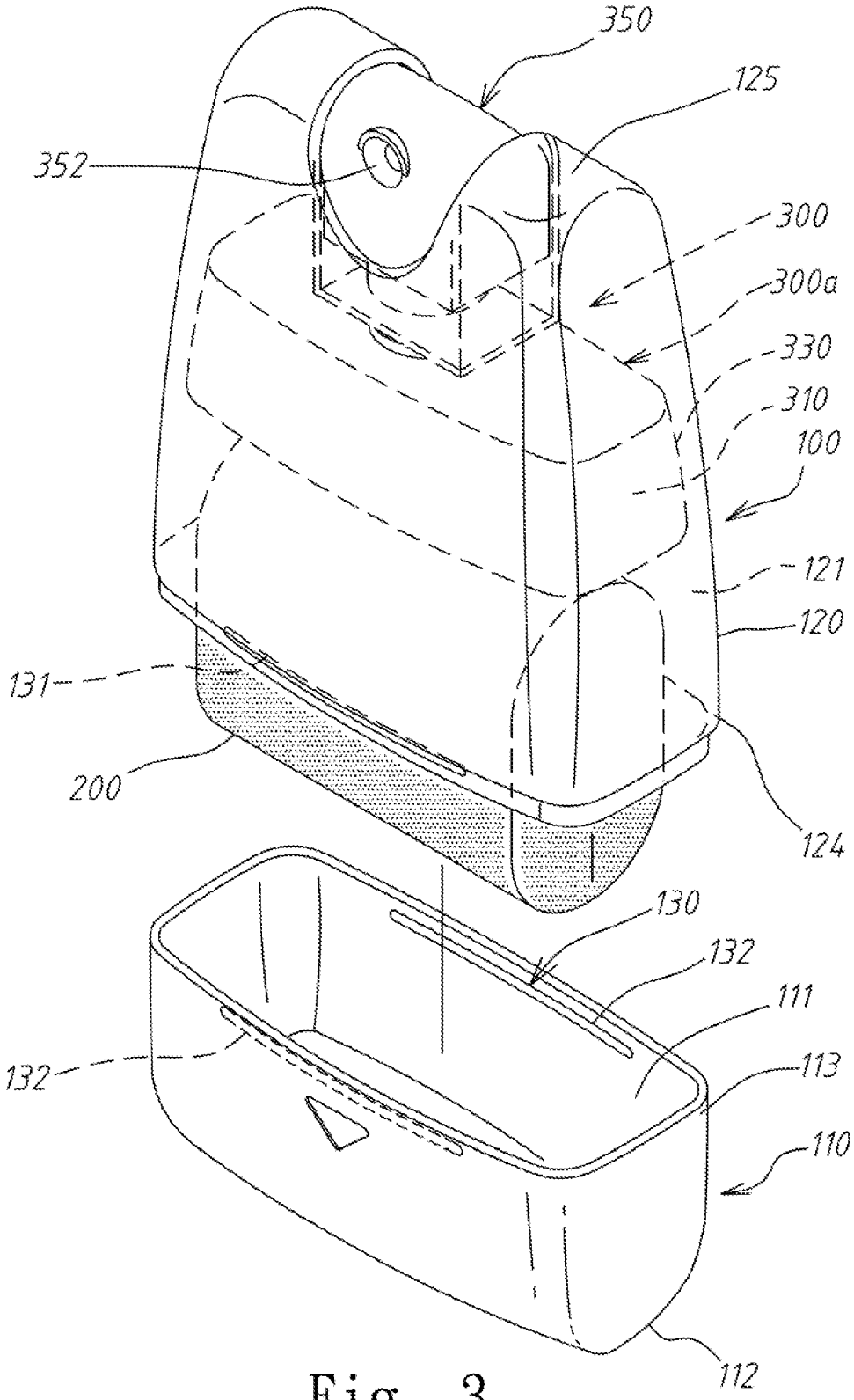
FIG. 3 illustrates a pictorial drawing of the detached the first housing and the second housing of the dual-functional screen cleaner of FIG. 1
Figure 5:
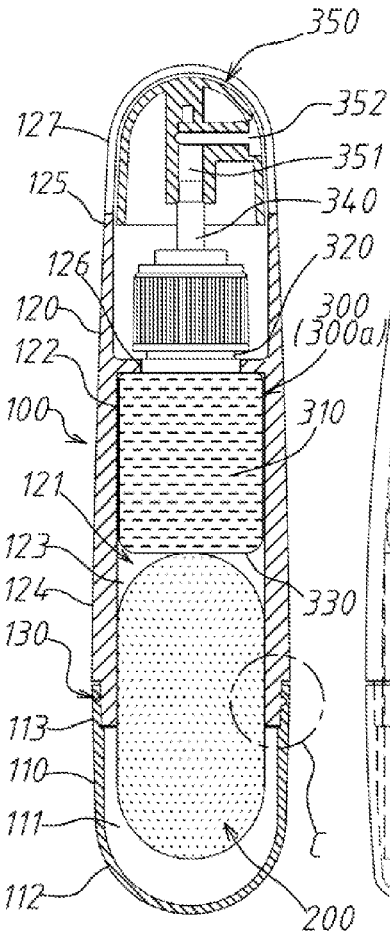
FIG. 5 illustrates a sectional view taken alone line A-A of FIG. 4.
Figure 4:
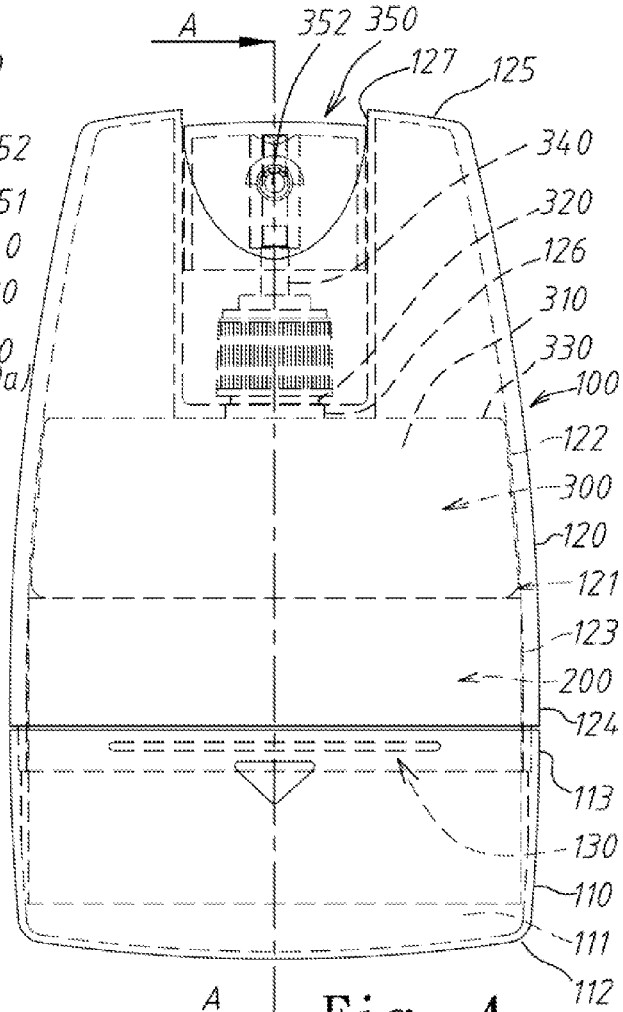
FIG. 4 illustrates a front view of the dual-functional screen cleaner of FIG. 1.
Figure 6:
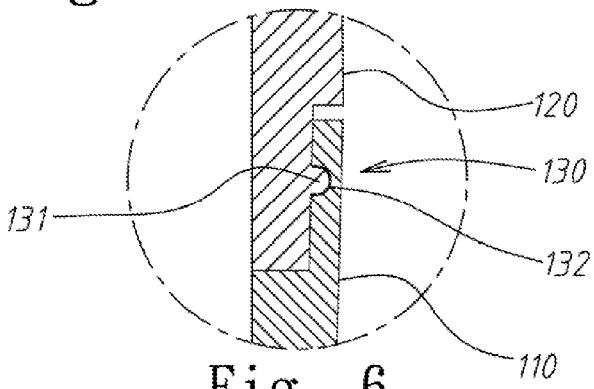
FIG. 6 illustrates an enlarge view taken from C of the dual-functional screen cleaner of FIG. 5.
Figure 9:
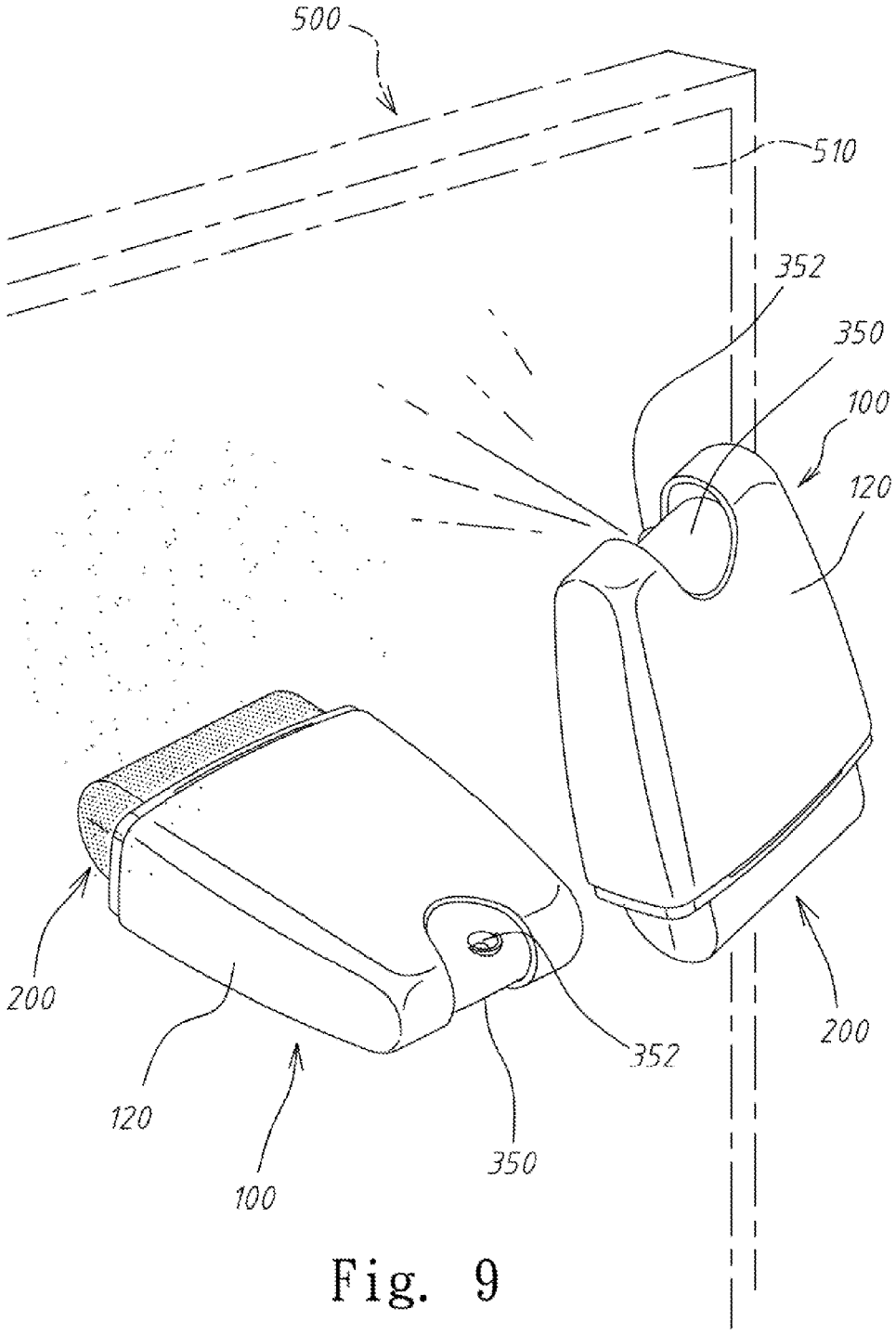
FIG. 9 illustrates a schematic diagram of using the dual-functional screen cleaner according to first and second embodiments of the present disclosure.

FIG. 3 and FIG. 9 illustrate schematic diagrams of using the dual-functional screen cleaner according to first and second embodiment of the present disclosure. During operating the dual-functional screen cleaner, pull down the first housing 110 to allow the first groove 132 of the first housing 110 to detach from the first hook 131 of the second housing 120, and thus the first housing 110 and the second housing 120 are separated and the cleaning body 200 is exposed. Afterwards, press one end of the pressuring element 350 of the second housing 120 to spray the cleaning liquid to dirty places of a control panel 510. Following, hold the second housing 120 reversely, and wipe those dirty places with the cleaning body 200. Therefore, the dual-functional cleaner equipped with cleaning liquid container 300 and cleaning body 200 integrally could clean the control panel 510 readily in wet form (cleaning liquid) and dry form (cleaning fabric) both.

Figure 10:
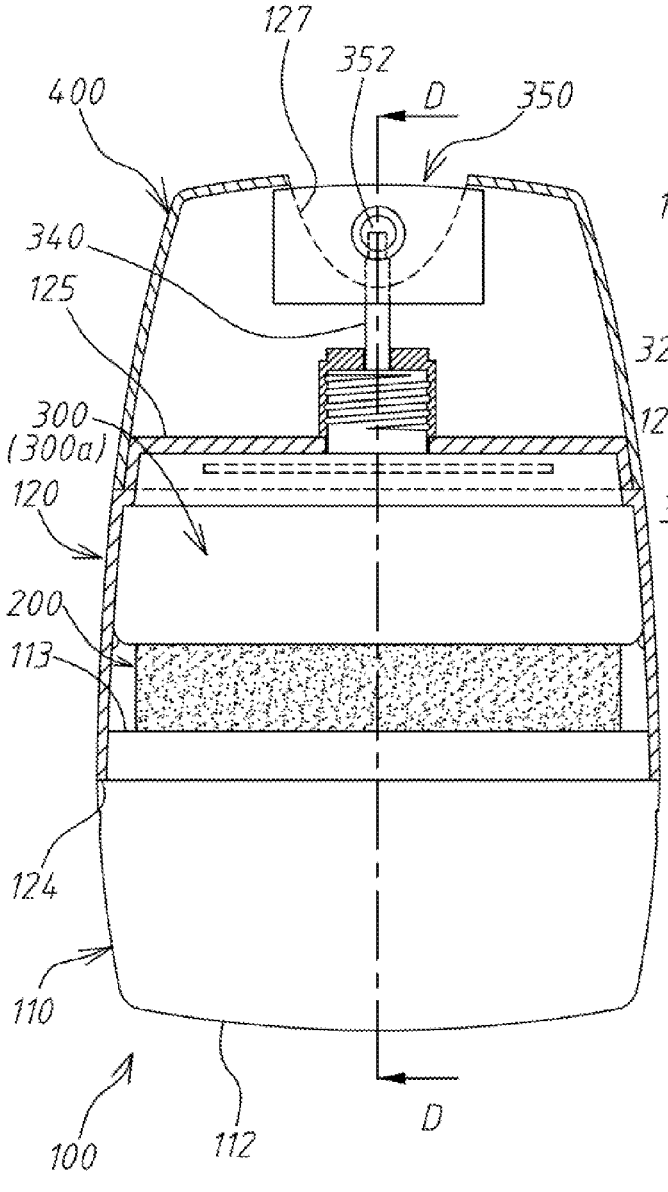
FIG. 10 illustrates a front view of a dual-functional screen cleaner according to third embodiment of the present disclosure
Figure 11:
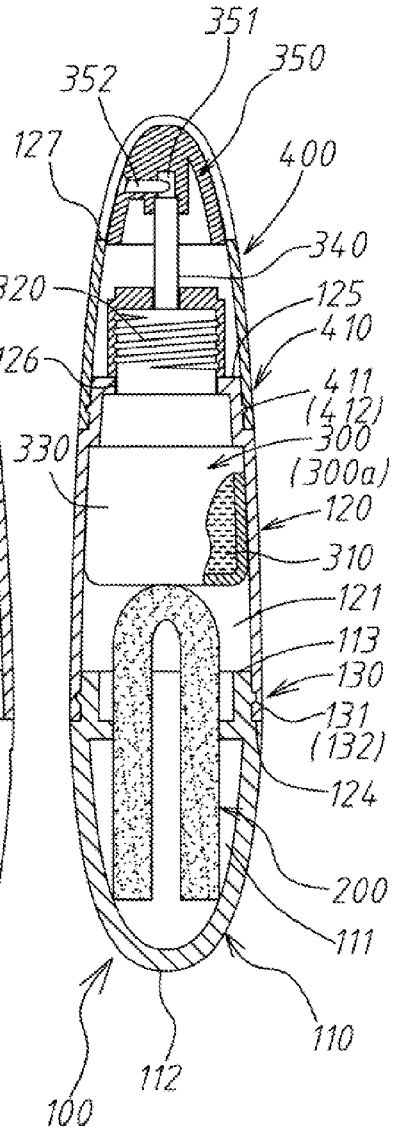
FIG. 11 illustrates a sectional view taken alone line D-D of FIG. 10.

After completing cleaning the screen, the first housing 110 could assemble with the second housing 120 by fastening the first hook 131 with the first groove 132. Therefore, the first housing 110 and the second housing 120 could be assembled together FIG. 10 and FIG. 11 illustrate a front view and a sectional view of a dual-functional screen cleaner according to third embodiment of the present disclosure. Referring to FIG. 10 and FIG. 11, a dual-functional screen cleaner further includes a housing unit 100, a cleaning body 200 and a cleaning liquid container 300 according to the third embodiment of the present disclosure. The main differences between third embodiment and the above-mentioned first and second embodiments are lies on the cleaning body 200, which is removably accommodated in the housing unit 100, especially in the first housing trough 111 of the first housing 110. Besides, the top of the second housing 120 fastens with a cover 400.

Furthermore, in third embodiment, the housing unit 100 includes a first housing 110 and a second housing 120 opposite the first housing 110, the first housing 110 and the second housing having a first housing 110 trough and a second housing trough 121 respectively. The first housing 110 has a first end 112 and a corresponding second end 113. The second housing 110 has a third end 124 and a corresponding fourth end 125 opposite the third end 124. A first fastening member detachably fastening the third end 124 to the second end 113. Basically, the first fastening member includes at least one first hook 131 located on an outer wall of the second end 113 and at least one first groove 132 located on an inner wall of the third end 124, the first hook 131 is located opposite and detachably fastening to the first groove 132.

The cleaning body 200 could be a cleaning fabric, which could be removably accommodated in the first housing trough 111 of the first housing 110. A part of the cleaning body 200 protrudes out of the second end 113, and face to the second housing trough 121 of the second housing 120. As the first housing 110 is combined with the second housing 120, the cleaning body 200 is accommodated in the lower housing trough 123 and the first housing trough 111 collectively, and a part of the cleaning body 200 protruding out of the third end 124 is covered by the first housing 110. As the first housing 110 and the second housing 120 are separated, the second housing 120 works as a holding part, and a part of the cleaning body 200 protruding out of the third end 124 is enable to clean the screen.

The cleaning liquid container 300 locates in the second housing trough 121, and the cleaning liquid container 300 has an accommodating room and a protrusion 320 that communicate with each other. The protrusion 320 protrudes out of the top of the second housing trough 121 and faces the fourth end 125. A tube screws to the protrusion 320. A pressuring element 350 caps the tube 340, so that the cleaning liquid could be pressed out form the accommodating room 310. In one embodiment, the cleaning liquid container 300 could be an individual element that could further accommodated in the second housing 120, or the cleaning liquid container 300 could be formed with the second housing 120 integrally.

The third embodiment shown in FIG. 10 and FIG. 11 presents the cleaning liquid container 300, which is an individual element that could further accommodated in the second housing 120. In this embodiment, a top of the second housing trough 121 has a hole 126, the cleaning liquid container 300 is a bottle 300*a*, the bottle 300*a* has a body part 330 and a protrusion communicating to the body part 330, an interior of the body part 330 defines a accommodating room 310, the body part 330 is removably accommodated in the second housing trough 121. When the body part 330 is accommodated in the second housing trough 121, the protrusion 320 passes through the hole 126 and protrudes out of the top of the second housing trough 121.

The second fastening member 410 fastens the cover to the fourth end 125 of the second housing 121 for covering the protrusion 320 of the cleaning liquid container 300 and the tube 340. In one embodiment, the second fastening member 410 includes at least one second hook 411 located on an outer wall of the fourth end 125 and at least one second groove located on an inner wall of the cover 400, and the first hook 131 is located opposite and detachably engages with first groove 132.

The top of the cover 400 has a hollowed trough 127, the pressuring element 350 is located in an interior of the hollowed trough 127, the pressuring element 350 has a vertical channel 351 and a horizontal nozzle 352 that communicate with each other, the vertical channel 351 is coupled with the tube 340, and the horizontal nozzle 352 is exposed to the hollowed trough 127.

Figure 12:
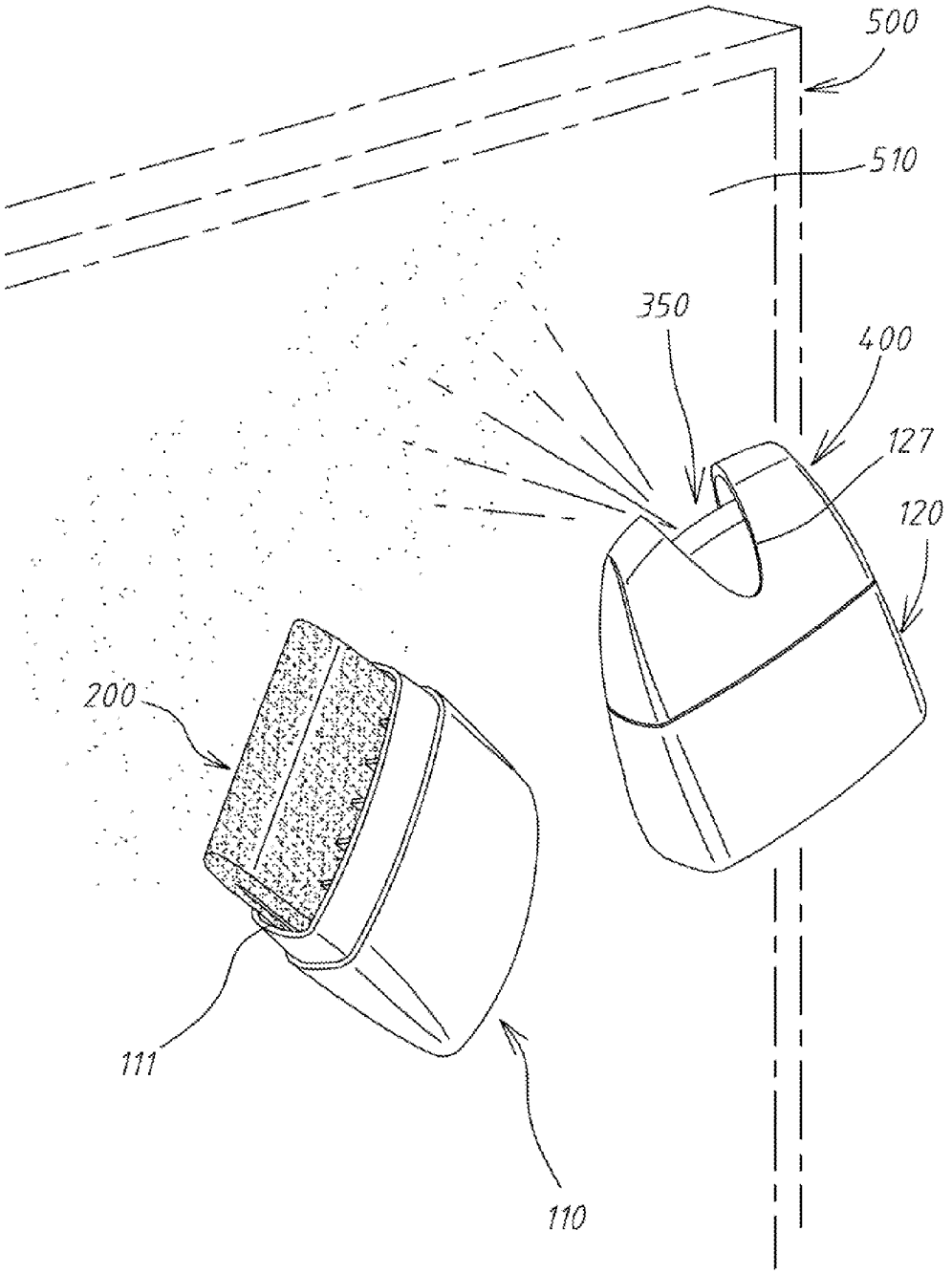
FIG. 12 illustrates a schematic diagram of using the dual-functional screen cleaner according to third embodiment of the present disclosure.

FIG. 12 illustrates a schematic diagram of using the dual-functional screen cleaner according to third embodiment of the present disclosure. Pull down the second end 113 of the first housing 110 to detach the first hook 131 of the first housing 110 from the first groove 132 of the second housing 120, resulting in the first housing 110 and the second housing 120 are separated and the cleaning body 200 is exposed. Following, press the pressuring element 350 on the top of the cover 400 to allow the cleaning liquid to be sprayed on the dirty place of the control panel 510. Hold the first housing 110 and then clean the dirty place by wiping them with the cleaning body 200. Therefore, the dual-functional cleaner equipped with cleaning liquid container 300 and cleaning body 200 integrally could clean the control panel 510 readily in wet form (cleaning liquid) and dry form (cleaning fabric) both.

As the description above, the embodiment of the present disclosure provides a dual-functional screen cleaner with a housing unit having the cleaning liquid container and the cleaning body integrally, which provides dual-function of cleaning and is portable and easily transported. Accordingly, the present disclosure achieves the purpose of the invention.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A dual-functional screen cleaner for cleaning a screen, the dual-functional screen cleaner comprising:

a housing unit comprising a first housing and a second housing opposite the first housing, the first housing and the second housing having a first housing trough and a second housing trough respectively, the second housing trough comprising an upper housing trough and a lower housing trough opposite the upper housing trough, the first housing having a first end and a second end opposite the first end, and the second housing having a third end and a fourth end opposite the third end;

a first fastening member detachably fastening the second end to the third end;

a cleaning body removably accommodated in the lower housing trough, wherein a part of the cleaning body protrudes out of the third end; and a cleaning liquid container located in the upper housing trough, wherein the cleaning liquid container has a accommodating room and a protrusion that communicate with each other, and the protrusion protrudes out of the top of the upper housing trough and faces the fourth end;

a tube screwed to the protrusion to fix the cleaning liquid container on the second housing; and a pressuring element capping the tube.

2. The dual-functional screen cleaner of claim 1, wherein a top of the upper housing trough has a hole, the cleaning liquid container is a bottle, the bottle has a body part communicating with the protrusion, an interior of the body part defines the accommodating room, the body part is removably accommodated in the upper housing trough, and when the body part is accommodated in the upper housing trough, the protrusion passes through the hole and protrudes out of the top of the upper housing trough.

3. The dual-functional screen cleaner of claim 1, wherein the protrusion and the top of the upper housing trough are integrally formed, the protrusion communicates with the upper housing trough, a sealing bottom seals between the upper housing trough and the lower housing trough, the protrusion, the upper housing trough, and the sealing bottom cooperate to define the cleaning liquid container, and the upper housing trough defines the accommodating room.

4. The dual-functional screen cleaner of claim 1, wherein the first fastening member comprises at least one first hook disposed on an outer wall of the third end and at least one first groove disposed on an inner wall of the second end, and the first hook is located opposite and detachably engages with the first groove.

5. The dual-functional screen cleaner of claim 1, wherein the fourth end of the second housing has a hollowed trough, the pressuring element is located in an interior of the hollowed trough, the pressuring element has a vertical channel and a horizontal nozzle that communicate with each other, the vertical channel is coupled with the tube, and the horizontal nozzle is exposed to the hollowed trough.

6. The dual-functional screen cleaner for cleaning a screen, the dual-functional screen cleaner comprising:

a housing unit comprising a first housing and a second housing opposite the first housing, the first housing and the second housing having a first housing trough and a second housing trough respectively, the first housing has a first end and a corresponding second end; the second housing has a third end and a corresponding fourth end opposite the third end;

a first fastening member detachably fastening the third end to the second end;

a cleaning body removably accommodated in the first housing trough, wherein a part of the cleaning body protrudes out of the second end; and a cleaning liquid container located in the second housing trough, the cleaning liquid container has a accommodating room and a protrusion that communicate with each other, and the protrusion protrudes out of the top of the second housing trough and faces the fourth end;

a tube screwed to the protrusion to fix the cleaning liquid container on the second housing; and a pressuring element capping the tube.

7. The dual-functional screen cleaner of claim 6, wherein a top of the second housing trough has a hole, the cleaning liquid container is a bottle, the bottle has a body part communicating, an interior of the body part defines a accommodating room, the body part is removably accommodated in the second housing trough, and when the body part is accommodated in the second housing trough, the protrusion passes through the hole and protrudes out of the top of the second housing trough.

8. The dual-functional screen cleaner of claim 6, wherein the first fastening member comprises at least one first hook disposed on an outer wall of the second end and at least one first groove disposed on an inner wall of the third end, the first hook is located opposite and detachably fastening to the first groove.

9. The dual-functional screen cleaner of claim 6, wherein a dual-functional screen cleaner further comprising a cover and a second fastening member, the second fastening member fastening the cover to the fourth end of the second housing.

10. The dual-functional screen cleaner of claim 9, wherein the second fastening member comprises at least one second hook disposed on an outer wall of the fourth end and at least one second groove disposed on an inner wall of the cover, and the first hook is located opposite and detachably engages with first groove.

11. The dual-functional screen cleaner of claim 9, wherein a top of the cover has a hollowed trough, the pressuring element is located in an interior of the hollowed trough, the pressuring element has a vertical channel and a horizontal nozzle that communicate with each other, the vertical channel is coupled with the tube, and the horizontal nozzle is exposed to the hollowed trough.

* * * * *